US010840038B2

(12) United States Patent
Hao

(10) Patent No.: US 10,840,038 B2
(45) Date of Patent: Nov. 17, 2020

(54) KEYSWITCH MECHANISM WITH HORIZONTAL MOTION RETURN MECHANISM

(71) Applicants: Juwilia Lim, Oakville (CA); Pat Hao, Mississauga (CA)

(72) Inventor: Pat Hao, Mississauga (CA)

( * ) Notice: Subject to any disclaimer, the term of this patent is extended or adjusted under 35 U.S.C. 154(b) by 0 days.

(21) Appl. No.: 15/780,434

(22) PCT Filed: Dec. 2, 2016

(86) PCT No.: PCT/CA2016/051414
§ 371 (c)(1),
(2) Date: May 31, 2018

(87) PCT Pub. No.: WO2017/091901
PCT Pub. Date: Jun. 8, 2017

(65) Prior Publication Data

US 2018/0366284 A1 Dec. 20, 2018

(30) Foreign Application Priority Data

Dec. 2, 2015 (CA) ..... 2913671

(51) Int. Cl.
*H01H 13/7073* (2006.01)
*H01H 13/52* (2006.01)

(52) U.S. Cl.
CPC ... *H01H 13/7073* (2013.01); *H01H 2013/525* (2013.01); *H01H 2215/03* (2013.01); *H01H 2215/034* (2013.01); *H01H 2227/036* (2013.01); *H01H 2235/006* (2013.01); *H01H 2235/012* (2013.01)

(58) Field of Classification Search
CPC ..... H01H 13/26; H01H 13/285; H01H 13/36; H01H 13/365; H01H 13/7073; H01H 2013/525; H01H 2235/006; H01H 2235/012; G06F 3/02
See application file for complete search history.

(56) References Cited

U.S. PATENT DOCUMENTS 4,059,737 A 11/1977 Gergaud
4,118,611 A 10/1978 Harris
4,528,431 A * 7/1985 Coleman, III ..... H01H 13/28 200/408
5,924,553 A 7/1999 Yeh
5,971,637 A * 10/1999 Malhi ..... G06F 1/1616 361/679.13
6,257,782 B1 * 7/2001 Maruyama ..... H01H 3/125 200/344
8,206,047 B1 6/2012 Isaac et al.
9,236,206 B1 * 1/2016 Chou ..... H01H 13/7073
(Continued)

*Primary Examiner* — Vanessa Girardi

(57) ABSTRACT

Described herein are thin keyboard and thin keyboard overlay, as well as novel key assembly for uses on keyboards and keyswitches. The key assembly includes a top plate, a movable keycap, a support plate and flexible rods embedded in the support plate acting as springs. The underside of the movable keycap has at least one or several tapered protrusions which are located above the flexible rods. A vertical downward force on the movable keycap will enable the protrusion to flex the rods horizontally, thus creating a spring like mechanism that will return the movable keycap to its original position once the vertical force is removed.

39 Claims, 16 Drawing Sheets

(56) References Cited

U.S. PATENT DOCUMENTS

| | | | | |
|---|---|---|---|---|
| 9,829,990 | B2 * | 11/2017 | Huang | G06F 3/02 |
| 2004/0130526 | A1 | 7/2004 | Rosenberg | |
| 2006/0256090 | A1 * | 11/2006 | Huppi | A63F 13/02 345/173 |
| 2012/0299832 | A1 | 11/2012 | Peterson et al. | |

* cited by examiner

KEYSWITCH MECHANISM WITH HORIZONTAL MOTION RETURN MECHANISM

BACKGROUND ART

1. Field of the Invention

The present invention relates to keyboard, keyboard overlay and keyswitch. More specifically, embodiments of the invention relate to a simple, compact, thin key assemblies for use on keyboards and keyswitches.

2. Description of Prior Art

With the advance in mobile computing and portable device, keyboards are being made smaller, thinner and lighter. FIG. 1A illustrates a conventional coil spring keyboard as disclosed in U.S. Pat. No. 4,118,611. The buckling spring mechanism 2 atop the pivoting hammer 7 is responsible for the tactile and aural response of the keyboard. Upon bucking, the small hammer is pivoted forward by the spring and strikes an electrical contact which registers the key press. FIG. 1B illustrates a keyboard using the scissor mechanism as disclosed in U.S. Pat. No. 5,924,553. The keycap 22 is connected to baseboard 20 via two plastic pieces 24 and 26 that interlock in a scissor like mechanism. A rubber dome 28 is located underneath the keycap 22 provides a mean to recover the keycap as the keycap is undepressed. While both keyboards achieve the objective of command input, the coil spring and the scissor keyboard structure require larger height, resulting in the limit of how small and thin such keyboard can be made. Moreover, the scissor mechanism is more complex and costly to manufacture. FIG. 2 illustrates a thin keyboard overlay as disclosed in U.S. Pat. No. 8,206,047. The keyboard overlay is designed to place on top of a virtual keyboard of a touch sensitive screen. The keyboard is made of thin sheet of elastomer and the key is form with internal support structure 75 in order to create user tactile feedback of a conventional keyboard such as finger resting resistance, pre-actuation cues, finger positioning cues and key identification cues. Although, the keyboard imitates the typing feel of a tactile keyboard on a touch surface, the rubber feel of the key is different than the crispness and the fast response of a conventional coil spring keyboard. Another thin keyboard is disclosed in U.S. Patent No. US2012/0169603 as shown in FIG. 3. The keyboard implements a set of incline ramps 652,654,656 and 658 as a path to guide the movable keycap 320 and uses the attraction/repulsion forces of magnets 620 and 630 as a return mechanism and to hold the keycap within the key structure. There are several weakness in this design. First the user tactile feedback is limited, there is no pre-actuation cue, no audible feedback. Second, the assembly of each key requires one magnet in the keycap and another magnet in the support base which adds complexity and cost to the manufacturing of a keyboard. Third, due to the design concept, there is a gap between the movable keycap 320 and the key structure 310 where dust can enter and the movable keycap 320 can fall out without a top cover holding it securely.

As will be disclosed herein, the present invention provides a simple, but thin and cost effective keyboard assembly, keyboard overlay and keyswitch with tactile and audible feedbacks which overcomes the inherent disadvantages of prior art devices.

SUMMARY OF INVENTION

To achieve the above-mentioned objectives, the present invention provides a key assembly capable of recovering a keycap by using a novel return mechanism. Conventional keyboards use the compression of a spring, the elasticity of a rubber dome or the deformation of a metallic dome to create a return mechanism. Such methods require both the keycap and the return mechanism to move proportionally in the same direction, which mean the spring, rubber or metallic dome require more height in order to compress or expand inside the key assembly. The present invention removes such height limitation and provides a method by which a vertical force pressing against a keycap will impact the return mechanism horizontally instead of vertically. Furthermore, the present invention provides tactile responses to the user such as finger resting, pre-actuation cue and audible cue.

The first embodiment of the key assembly comprises five main elements: a top plate, a movable keycap, a support plate with embedded flexible rods and a key switch layer. The top plate keeps the movable keycap position properly within the support plate. The movable keycap has recessed edge serving as positioner for the top plate to hold the movable keycap within the support plate. Located within the support plate are two flexible rods position substantially parallel to each other. The underside of the movable keycap has a tapered protrusion position a top of the two flexible rods. The preloaded spring tension between the flexible rods and the movable keycap keeps the movable keycap level within the support plate. A vertical keypress forces the tapered protrusion on the underside of the movable keycap to flex the flexible rods horizontally. The proportional increased in strength require to further depress the keycap provides the user a resistance feel or pre-actuation cue. Further depression will reach the end of the tapered protrusion as the flexible rods hit the underside of the movable keycap which creates an audible cue. The tapered protrusion also serves as a contact point to activate the key switch layer. Once, the depression is released, the flexible rods snap back, thus acting as a return mechanism for the movable keycap. The snaps back action of the flexible rods propel the movable keycap against the top plate which create a second audible click.

DETAILED DESCRIPTION OF THE PREFERRED EMBODIMENTS

Figure 1A:
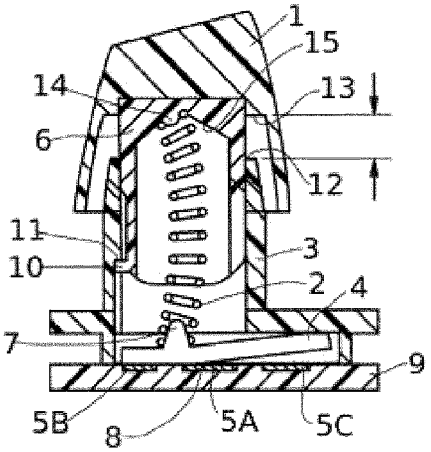
FIG. 1A (PRIOR ART)
FIG. 1A is a side view showing the structure of the buckling spring assembly of a conventional keyboard.
Figure 1B:
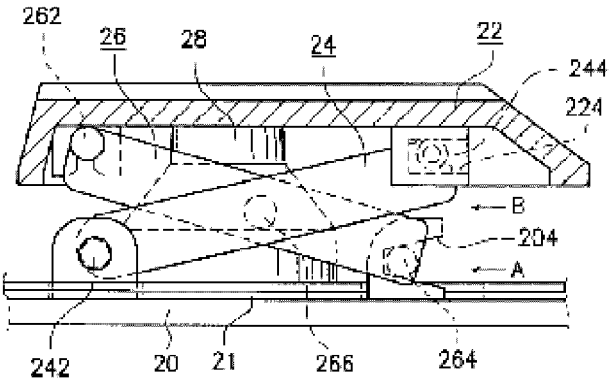
FIG. 1B (PRIOR ART)
FIG. 1B is a side view showing the structure of a scissor mechanism of a conventional keyboard.
Figure 2:
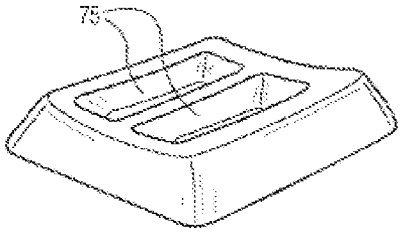
FIG.2 (PRIOR ART)
FIG. 2 is an isometric view showing the design of an elastomer keycap of a conventional keyboard overlay.
Figure 3:
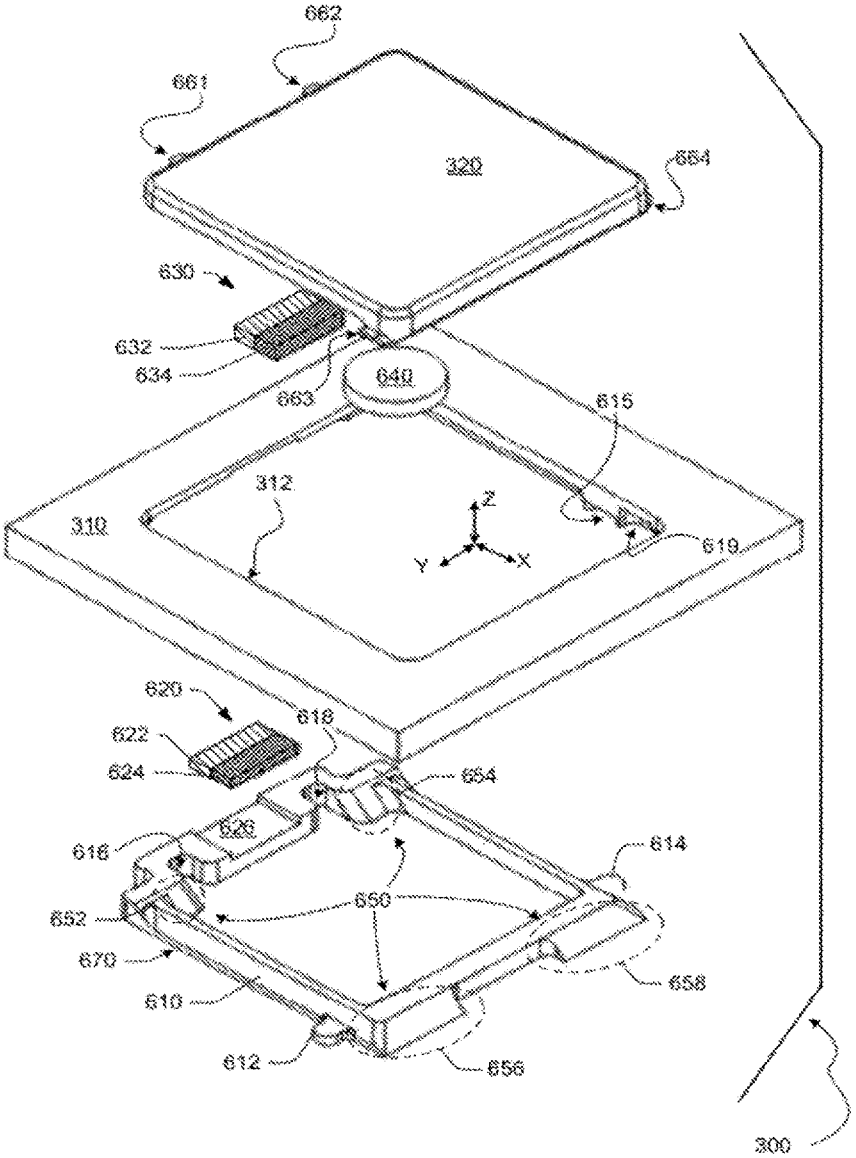
FIG.3 (PRIOR ART)
FIG. 3 is an exploded isometric illustrating the structure of a conventional keyboard with magnet as return mechanism.

The assembly shown in the drawings includes one key or two keys structure arrange in a row. It should be understood that keyboards of other configurations comprising plurality of keys assembly or a single keyswitch can be obtained from the same basic structure.

Figure 4:
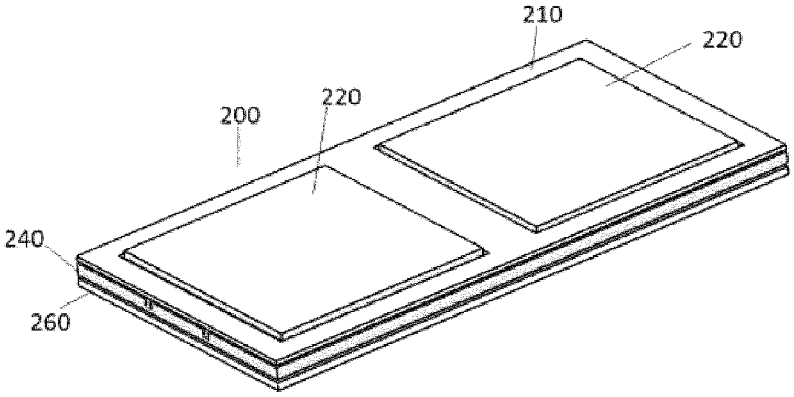
FIG. 4 is an isometric view of the first embodiment of the key assembly configured in accordance with the techniques described herein.
Figure 5A:
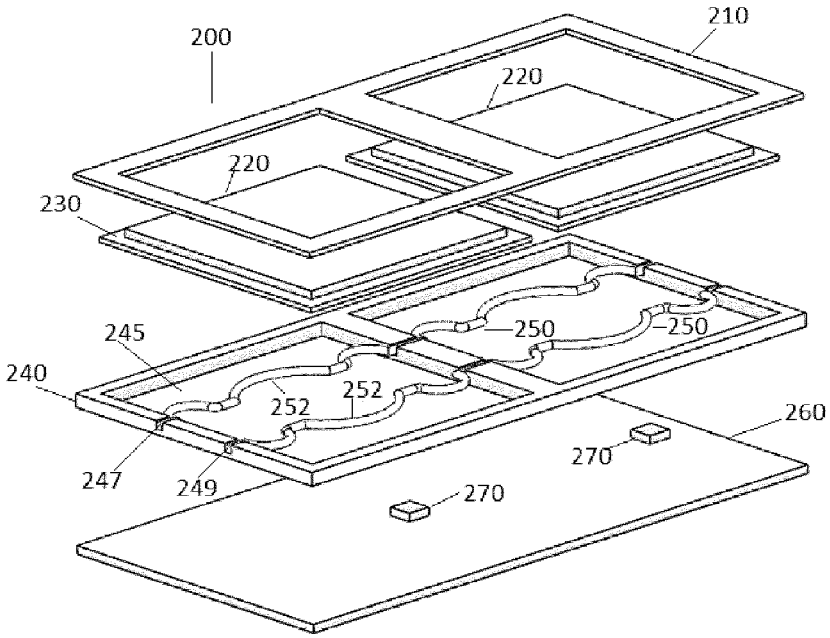
FIG. 5 is an exploded right isometric view showing the structure of the first embodiment.
Figure 5B:
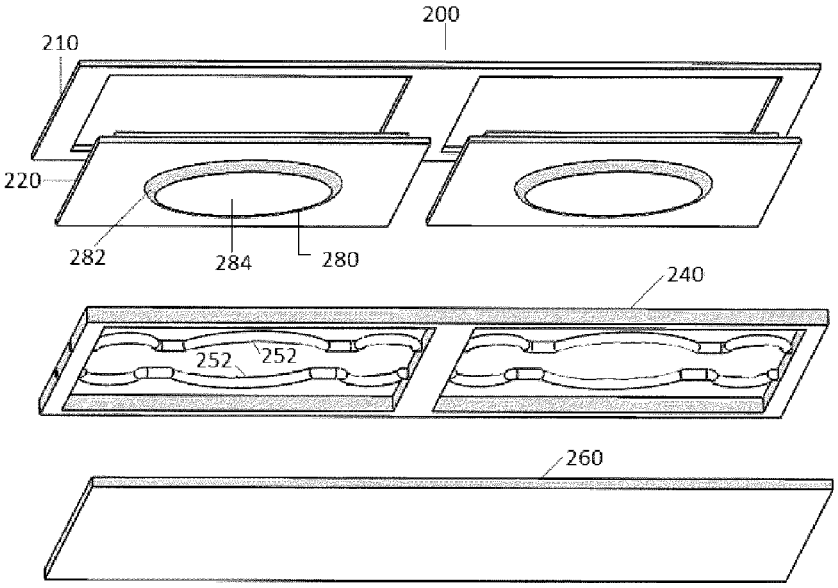

FIG. 4 shows an isometric view of the first embodiment of key assembly 200. The key assembly 200 comprises of top plate 210, a movable keycap 220, a support plate 240 and a key switch layer 260. The top plate 210 holds the movable keycap 220 securely within the keyhole 245 of the support plate 240 as depicted in FIG. 5A. The movable keycap 220 has recessed edge 230 which serves as a guide for the top plate 210 to align the movable keycap 220 within the keyhole 245 and hold it securely. Located on the underside of the movable keycap 220 is a protrusion of cylindrical shape 280 with a tapered edge 282 as shown in FIG. 5B. The tapered edge 282 rests atop of the two flexible rods 250 located within the support plate 240. The two flexible rods 250 are identical, but position as mirror image of each other within the support plate 240. The flexible rods 250 in conjunction with the tapered edge 282 function as the tension/return mechanism for the key assembly 200. At the ready position the movable keycap 220 is position atop the arcuate sections 252 of the two flexible rods 250. The arcuate sections 252 having similar contour as the protrusion 280 are pushing against the tapered edge 282 to keep the movable keycap 220 under preload tension and level against the top plate 210. The preload tension is important as it must provide enough resistive force to allow the typist to pause his or her finger on the movable keycap 220 when touch typing.

The shape of the protrusion 280 can varies, it can be a semi spherical, a semi cylindrical, a cone shape, a triangular prism, a square pyramid or other shape having a commonality is that the top section of the protrusion 280 that connect to the movable keycap 220 is less tapered than the lower section that is in contact with the flexible rods 250.

Figure 6:
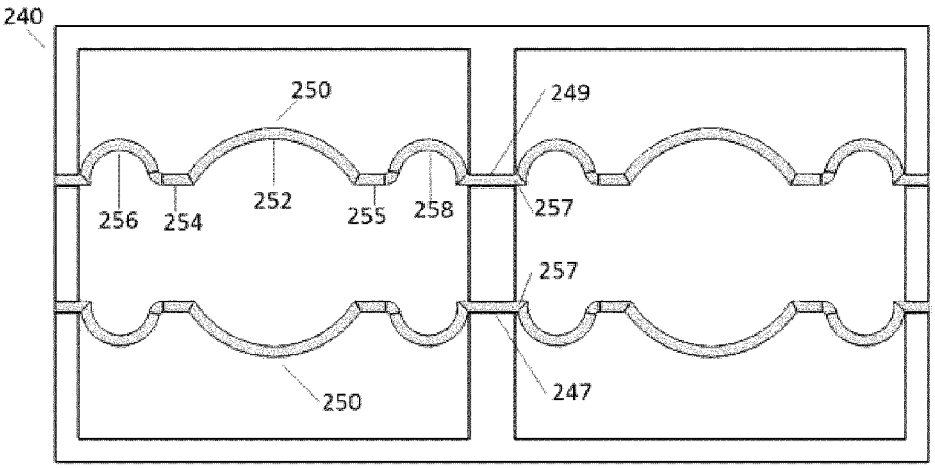
FIG. 6 is an exploded lower right isometric view showing the structure of the first embodiment of the keyboard assembly exposing the underside of the movable keycap.

Similarly, the shape and the function of the flexible rods are important to the design of the tension/return mechanism. FIG. 6 illustrates the different section of the flexible rods 250, they include an arcuate section 252, flat sections 254, a second flat section 255 and open loops sections 256 and 258. The flexible rods 250 are parallel and symmetrically installed in grooves 247 and 249 provided in the support plate 240. The function of the arcuate section 252 will be explained hereinafter in the description of the tension/return mechanism. The flat section 254 links the open loop section 256 to the arcuate section 252 and the flat section 255 links the open loop section 258 to the arcuate section 252. The open loop sections 256 and 258 enable the arcuate section 252 to expand and contract during the actuation of the movable keycap 220 independently with minimal impact to adjacent keys. Moreover, the flat sections 257 are held in place by grooves 247 and 249 which allows all the keys assembly on the same row to share the same flexible rod 250. Thus, this design simplifies the assembly of the keyboard and reduces manufacturing cost. Although, the flexible rods depicted in the present invention are round rods, it can be square rods, compression springs or flexible strips of other shape as long as they have the ability to expand and contract during actuation of the movable keycap 220. Naturally, the materials use for the flexible rods 250 are spring steel, metal alloy, plastic, or other composite material capable of retaining it shape after being subjected to a force causing a deflection.

Figure 7:
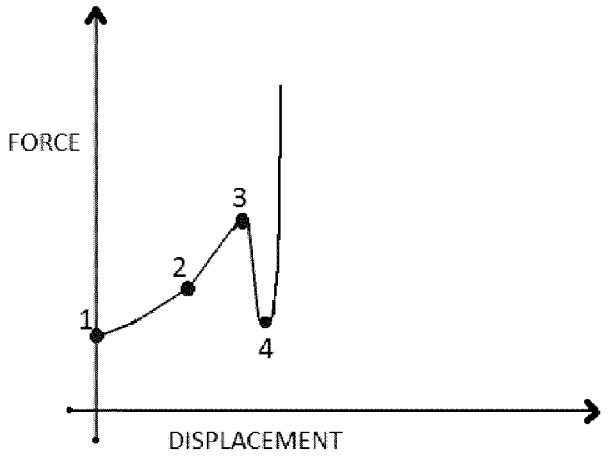
FIG. 7 shows a representative force displacement curve for the first embodiment return mechanism.
Figure 8:
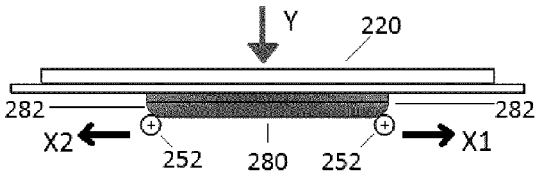
FIGS. 8, 9, 10, 11 are a sequence cross-sectional view showing the return mechanism being actuated.
Figure 9:
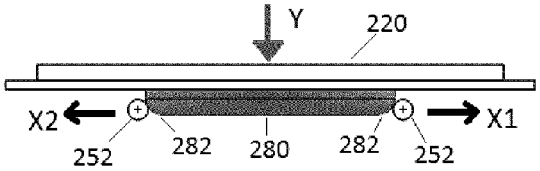
Figure 10:
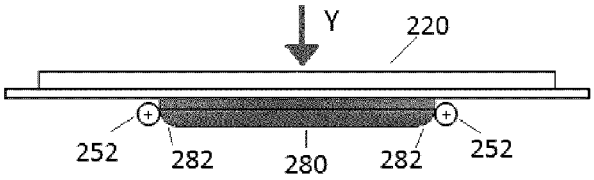
Figure 11:
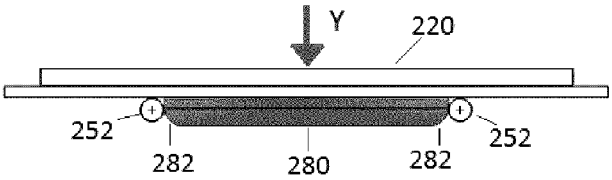
Figure 12A:
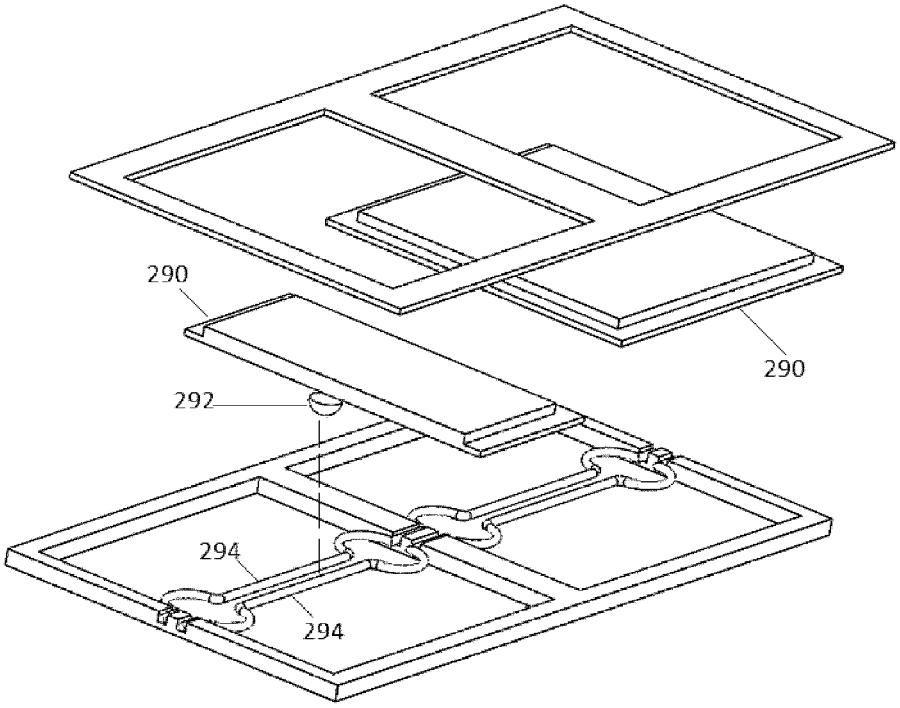
FIG. 12A is an exploded isometric view showing the assembly of an alternative return mechanism.
Figure 12B:
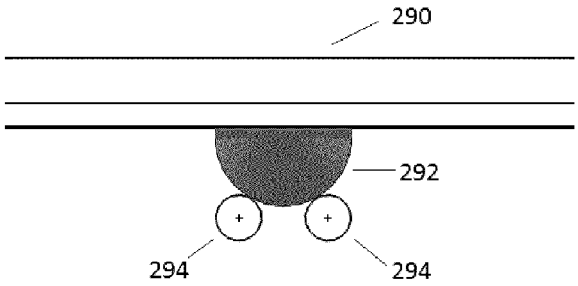
FIG. 12B shows a cross-sectional view of an alternative return mechanism.
Figure 12C:
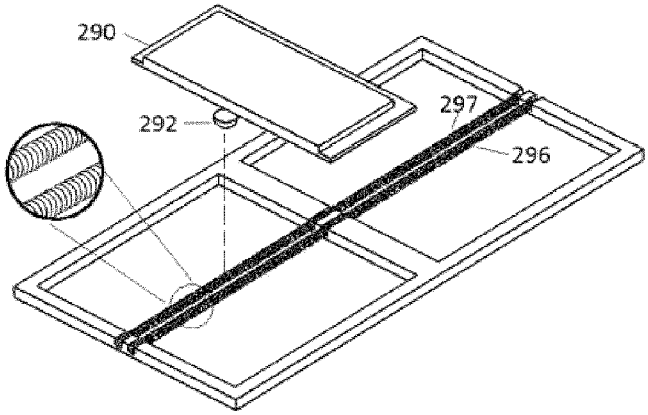
FIG. 12C illustrates an exploded isometric view of a compression spring return mechanism.

With reference to FIGS. 7-11, the operation of the tension/return mechanism of the key assembly 200 will be described. FIG. 7 illustrates the relationship between the downward force against the vertical displacement of the movable keycap 220. The point 1 on the graph in the FIG. 7 indicates the ready position, the movable keycap 220 is at rest under preload tension atop the arcuate section 252 of the flexible rods. FIGS. 8-9 illustrate cross-sectional views of the key assembly when a vertical downward force Y applies to the movable keycap 220, the tapered edge 282 will flexes the arcuate section 252 of the flexible rods 250 horizontally in the direction indicated by X1 and X2. The action of FIG. 8 and FIG. 9 is represented by line segment from point 1 to point 3 in the graph of FIG. 7 which shows further downward depression applies to the movable keycap 220 will required proportional increase in strength to overcome the resistive force of the flexible rods 250. At the point 3 on the graph in FIG. 7, less force is required to depress the movable keycap 220 due to the top section 282 of the protrusion 280 is no longer tapered as represented in FIG. 10. The rapid changes in the apply force between point 3 and point 4 is the pre-actuation cue which represents a tactile feedback to let the typist know that the end of the key travel is near. At point 4 depicted in FIG. 7 and illustrated in FIG. 11, the typist reaches the end of the key travel as the protrusion 280 touches the key switch layer 260 and the flexible rods hit the underside of the movable keycap 220, a clicking sound is generated providing an audible cue for the typist. Once the downward force is released from the movable keycap 220, the flexible rods 250 snap back to its original shape acting as a return mechanism for the movable keycap 220 by pushing against the protrusion 280. The snap back action of the flexible rods 250 propel the movable keycap 220 against the top plate 210 generating a second audible click. It provides a second audible cue to the typist that the movable keycap 220 is at the ready position. It should be obvious to anyone skill in the art that the arcuate section 252 need not always be an arc, but depending on the shape of the protrusion 280 and the tapered edge 282. FIG. 12A illustrates an example where the arcuate section 252 is not needed since the protrusion 292 is a small semispherical shape. The protrusion 292 located on the underside of the movable keycap 290 and rests atop of the two flexible rods 294. The two flexible rods 294 do not have an arcuate section where the protrusion 292 is positioned, but offer the same tension/return mechanism. FIG. 12B shows a cross sectional view of the protrusion 292 positioning atop the two flexible rods 294, which is similar in operating principle to the tension/return mechanism previously described. Additionally, the shape of the flexible rods can varies depending on the type of flexible rods used. FIG. 12C shows an example of using compression springs 296 and 297 as flexible rods. The compression springs 296 and 297 do not require arcuate sections or open loops since the compression springs expand or contract around the protrusion 292 acting as a return mechanism. Thus, a downward force acting on the movable keycap 290 will press the protrusion 292 against the compression spring 296 and 297 expanding the area around the protrusion 290. Once the actuating force is released from the movable keycap 290, the compression spring 296 and 297 contract back to its original shape propelling the movable keycap 290 upward to its original ready position.

Figure 13:
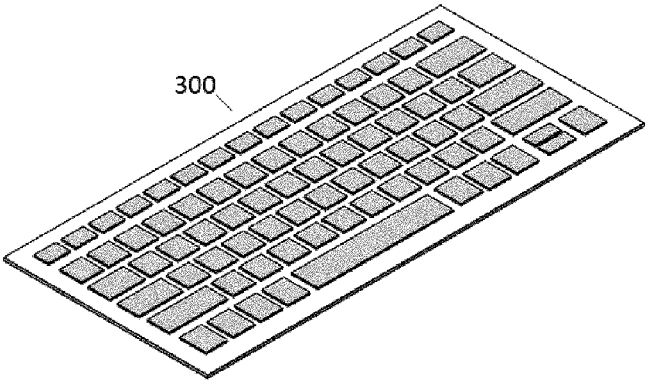
FIG. 13 shows a thin keyboard that is configured in accordance with the techniques described herein.

While FIG. 4 shows only two keys structure, a keyboard configuration 300 can be obtained from the same basic structure as shown in FIG. 13. A thin profile keyboard 300 can be implemented with the addition of a key switch layer 260 as shown in FIG. 5A. A key switch layer 260 can be of membrane type, printed circuit type or any suitable key switch may be used for the techniques described herein. A top the key switch layer 260 is a backlighting mean comprising of light source 270. The simplicity of the key assembly 200 differs from conventional keyboard since it has fewer parts that obstruct the light source. In conventional keyboard there are springs, metallic or rubber domes and scissor mechanisms that reduce the effectiveness of the backlighting source. The light source 270 can be implemented using LEDs, electroluminescent panels, diffuse light panel, advanced material composes of light emitting paper/film or other suitable technology.

Figure 14:
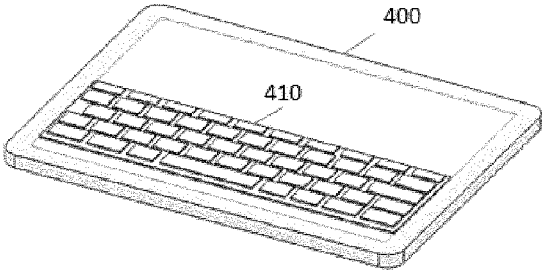
FIG. 14 shows a thin keyboard overlay that is used in conjunction with a tablet or a mobile device.

Without the key switch layer 260, the present invention can also be employed as a keyboard overlay for use on a touch screen surface. FIG. 14 shows an example of a keyboard overlay 410 designed to go on top of a virtual keyboard of a mobile device or tablet 400. The keyboard overlay 410 is composed of multiple key assembly 200 without the key switch layer 260, each of which is positioned a top a corresponding key of the underlying virtual keyboard. The keyboard overlay 410 gives the user the feel of a mechanical keyboard over a proximity-base touch surface and other characteristics beneficial to the touch typist such as fingers resting, pre-actuation cue and audible cues.

Figure 15:
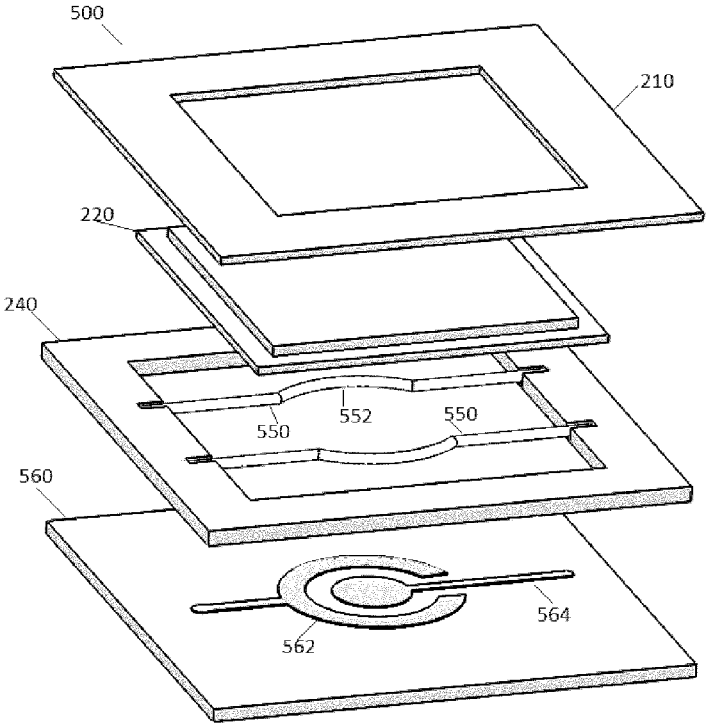
FIG. 15 shows an exploded isometric view of a keyswitch configure according to the first embodiment.

Another implementation of the key assembly 200 is in a form of a low profile keyswitch 500 for use in electronics and computing devices as depicted in FIG. 15. The keyswitch 500 has the same top plate 210, the same movable keycap 220 and the same support plate 240 as key assembly 200. The only difference is the two flexible rods 550 contain the arcuate section 552 which serve the same tension/return mechanism as arcuate section 252 of the key assembly 200. Thus, the key structure is obvious and will not be described. The keyswitch operates by actuating the movable keycap 220 which brings the flat surface 284 of the protrusion 280 which is made of conductive material into contact with the printed circuit plate 560, thereby achieving an electrical coupling between the two electrical conductive strips 562 and 564.

Figure 16:
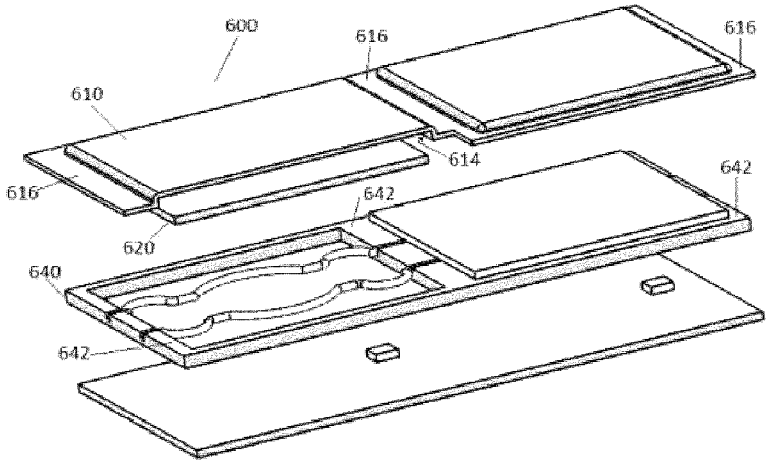
FIG. 16 shows an exploded isometric view of a second embodiment according to the present invention.

FIG. 16 shows another embodiment of the key assembly 600 according to this invention. The only difference between key assembly 600 and key assembly 200 is the top covering sheet. Alternative to top plate 210, a top covering sheet 610 is used. The key structure remains identical, only the top covering sheet 610 will be described. In certain application, it is preferable to have a keyboard that is both dust and water resistant. The key assembly 600 provides dust and water protection with the implementation of a thin, insulating and elastic top covering sheet 610. The top covering sheet 610 has the same basic shape as the movable keycap 620. The sectional view of the top covering sheet 610 shows a recess 614 which houses the movable keycap 620. The movable keycap 620 is held in position by top covering sheet 610 which covers all the surface of the key assembly. The top covering sheet 610 is fixed to the surface plate 640 via the periphery edge 616, which adheres to the periphery surface 642 of the supporting plate 640. The thickness of said top covering sheet 610 is such that when finger pressure is applied, the top covering sheet 610 is flexibly distorted and the corresponding movable keycap 220 is depressed.

Figure 17A:
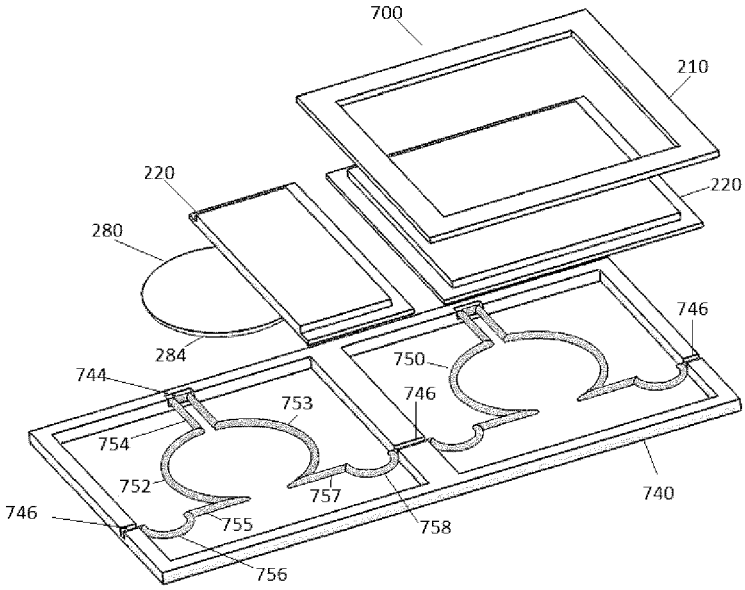
FIG. 17A illustrates an exploded isometric view of a third embodiment configure according with the techniques described herein.

FIG. 17A illustrates another embodiment of the key assembly 700 implementing the techniques described herein. The key assembly 700 uses a single flexible rod as the tension/return mechanism. The top plate 210, the movable keycap 220 and the key switch plate 260 (which is not shown) remain same as key assembly 200. Thus, only the tension/return mechanism will be described. Instead of two flexible rods each containing one arcuate section 252 as in key assembly 200, the single flexible rod 750 contains both arcuate section 752 and 753 atop of which the tapered edge 282 is positioned. The flexible rod 750 arcuate sections 752 and 753 have similar contour as the tapered edge 282 and is held in place to the support plate 740 by grooves 746 and 744. The square loop section 754 links the arcuate section 752 to the arcuate section 753. The flat section 755 links the arcuate section 752 to the open loop 756 and the flat section 757 links the arcuate section 753 to the open loop section 758. The combination of the square loop 754, the open loop section 756 and 758 allow the arcuate section 752 and 753 to expand and contract during the actuation of the movable keycap 220 with minimal impact to adjacent keys assembly. The single flexible rod 750 further simplify the design with ease of manufacturing and reduced costs, since all the keys structure on the same row share one flexible rod 750.

Figure 17B:
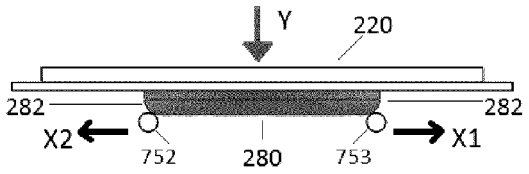
FIG. 17B shows a cross-sectional view of the return mechanism of the third embodiment.

FIG. 17B illustrates a cross sectional view of the key assembly 700 tension/return mechanism which shows the tapered protrusion 280 positioning atop the arcuate section 752 and 753 of the flexible rod 750. It displays the similar tension/return mechanism and operates in the same manner as previously described.

Figure 18A:
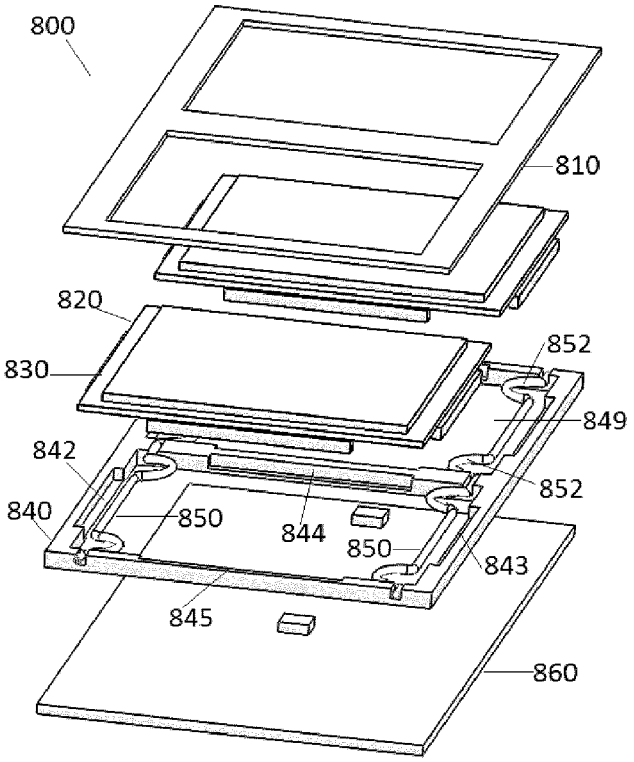
FIG. 18A shows an exploded isometric view of a fourth embodiment configure according with the techniques described herein.
Figure 18B:
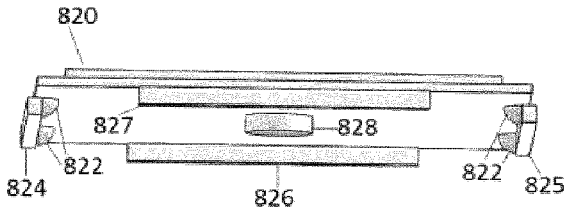
FIG. 18B shows an isometric view of the underside of the movable keycap from the fourth embodiment.
Figure 19A:
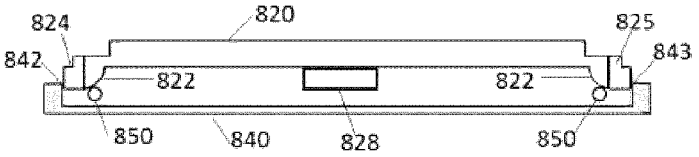
FIGS. 19A-19C illustrate the cross-sectional view of the return mechanism of the fourth embodiment.
Figure 19B:
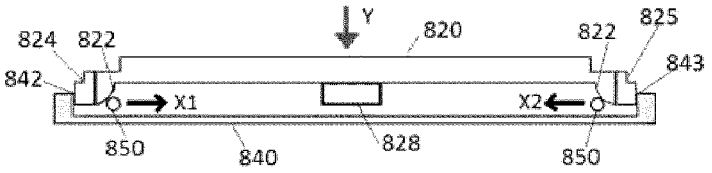
Figure 19C:
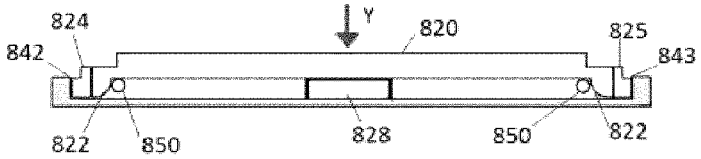

Referring to FIGS. 18A-18B, another configuration of the present invention can be obtained by positioning the flexible rods 850 near the internal edges of the supporting plate 840. The key assembly 800 comprises of a top plate 810, a movable keycap 820, a support plate 840 and a switch plate 860. The movable keycap 820 has recessed edge 830 which acts as guide for the top plate 810 to position the movable keycap 220 within the keyhole 849 and holds it securely. On the underside of the movable keycap 820 are retention tabs 824, 825, 826 and 827 which fit into recesses 842, 843, 844 and 845 located on the supporting plate 840. Attached to the retention tab 824 and 825 are protrusions 822 which have a tapered surface. The top of the protrusion 822 closer to the underside of the movable keycap 820 is less tapered than the bottom. The retention tabs 824, 825, 826 and 827 are design to keep protrusions 822 align properly atop the flexible rods 850 which serve as tension/return mechanism. The tension/return mechanism functions similarly to method described previously. FIGS. 19A-19C illustrate a cross-sectional view of the tension/return mechanism. FIG. 19A shows the movable keycap 820 at the ready position atop the flexible rods 850 with preload tension. FIG. 19B illustrates a keypress whereby a vertical downward force Y applies to the movable keycap 820 and pushes the tapered curve of the protrusion 822 against the flexible rods 850 forcing them to flex horizontally in direction marked by X1 and X2. FIG. 19C shows the movable keycap 820 reaches the end of the key travel where the switch contact member 828 striking against the switch plate 860 actuating a keystroke. At this stage, the flexible rods 850 are fully flexed. Once the pressure on the movable keycap 820 is released, the flexible rods revert back to their original shape and propel the movable keycap 820 back to its ready position. The user undergoes all the step described in the graph illustrated by FIG. 7. In addition, the user experiences the same tactile response and audible feedbacks, considering the protrusion 822 and flexible rods 850 behave similarly as previously depicted tension/return mechanism. Furthermore, the flexible rods 850 have open loops 852 which expand and contract allowing the flexible rods 850 to flex with minimal impact to the adjacent keys sharing the same row.

Figure 20A:
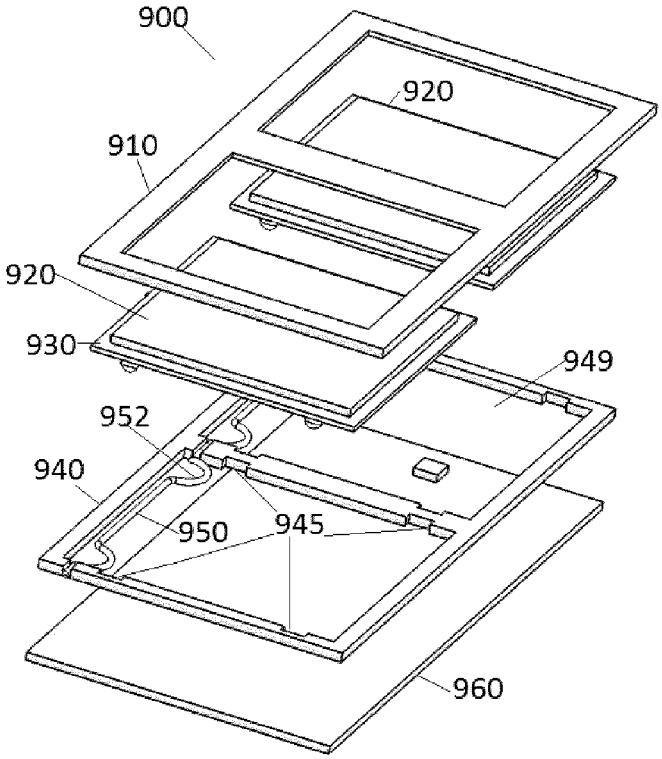
FIG. 20A shows an exploded isometric view of a fifth embodiment configure according with the techniques described herein.
Figure 20B:
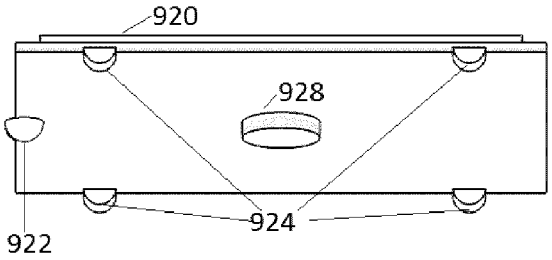
FIG. 20B shows an isometric view of the underside of the movable keycap from the fifth embodiment.
Figure 20C:
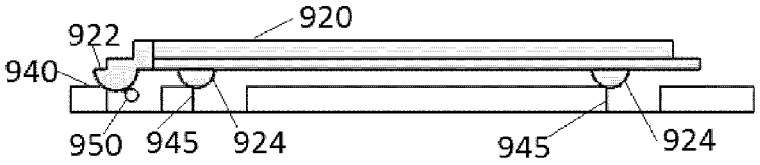
FIGS. 20C-20E illustrate the cross-sectional view of the return mechanism of the fifth embodiment with downward lateral motion.
Figure 20D:
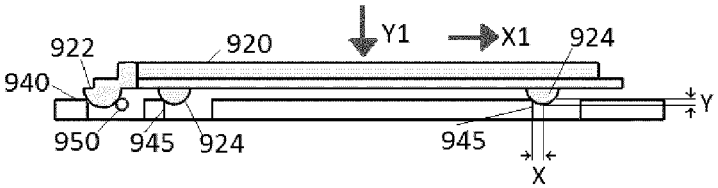
Figure 20E:
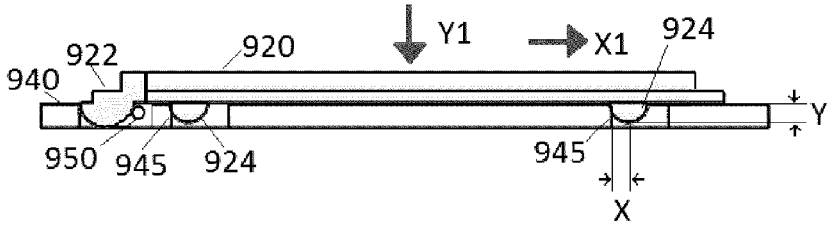

FIG. 20A illustrates another embodiment of the present invention, the key assembly 900 comprises of a top plate 910, a movable keycap 920, a support plate 940 and a switch plate 960. Although the keys assembly 900 configuration looks similar to key assembly 800: both use the same tension/return mechanism, but the effect on the movable keycap 920 and the user tactile feedback are different. The variation is in the underside of movable keycap 920 while the remaining component are similar. FIG. 20B shows the underside of the movable keycap 920, there are four semi cylindrical feet 924 and a tapered protrusion 922. Using the recess edge 930 as a guide, the top plate 910 aligns the movable keycaps 920 within the keyhole 949. At the ready position, the feet 924 are position atop the edges of the recesses 945 as illustrates FIG. 20C. The feet 924 are design to keep the movable keycap balance and stable within the support plate 940 during a keypress. The event of a keypress will be described with reference to FIGS. 20D-20E. The tension/return mechanism is the same as previous embodiment. Thus, only the difference in the motion of the movable keycap will be described. At rest, the movable keycap 920 is under preload tension from the flexible rod 950 and is held in position by the top cover 910. At the moment of a keypress, the tapered protrusion 922 which in this instance of a semi spherical shape pushes against the internal edge of the support plate 940 on one side and the flexible rod 950 on the opposite side resulting in a downward lateral slide motion for the movable keycap 920. That is, the movable keycap 920 slide a distance X in a lateral direction indicated by the arrow X1 and downward distance Y in the direction indicated by the arrow Y1 as shown on FIG. 20D. Once the end of the key travel is reached, the switch contact member 928 strikes the switch plate 960 actuating a keystroke. At this stage, the protrusion 922 pushes the movable keycap 920 furthest distance X in a lateral direction, Y reaches the maximum distance in downward direction and the flexible rod 950 is fully flexed as shown in FIG. 20E. Once, the pressure on the movable keycap 920 is removed, the flexible rod springs back to its original shape and propel the movable keycap 920 toward its ready position. The effect of movable keycap 920 lateral slide in the X1 direction gives the user a sense of longer key stroke, which enhances the typing feel in a thin keyboard. The actual movable keycap 920 travel can be calculate using Pythagoras's theorem. Therefore, the distance travel is the square root of the sum of X square and Y square. As previously mentioned, prior art U.S. Patent Pub. No. US2012/0169603 uses incline ramps to create the downward lateral motion of the keycap and the attraction/repulsion of magnets as return mechanism. The present embodiment uses the tapered protrusion 922 in conjunction with the flexible rod 850 to create similar motion. The advantage is a simpler design and low manufacturing cost. The present embodiment uses the same flexible rod for all the keys on the same row. Thus, instead of using 4 to 5 flexible rods: one flexible rod per row of keys. The prior art design needs to assemble over 50 keycaps and corresponding 50 keycaps base with magnets in order to create a keyboard. Another advantage is the top plate 910, a component the prior art patent does not used. The top plate 910 covers the movable keycap preventing dust and particle from entering the key structure and at the same time holds the keycap from falling out of the keyboard.

Figure 21:
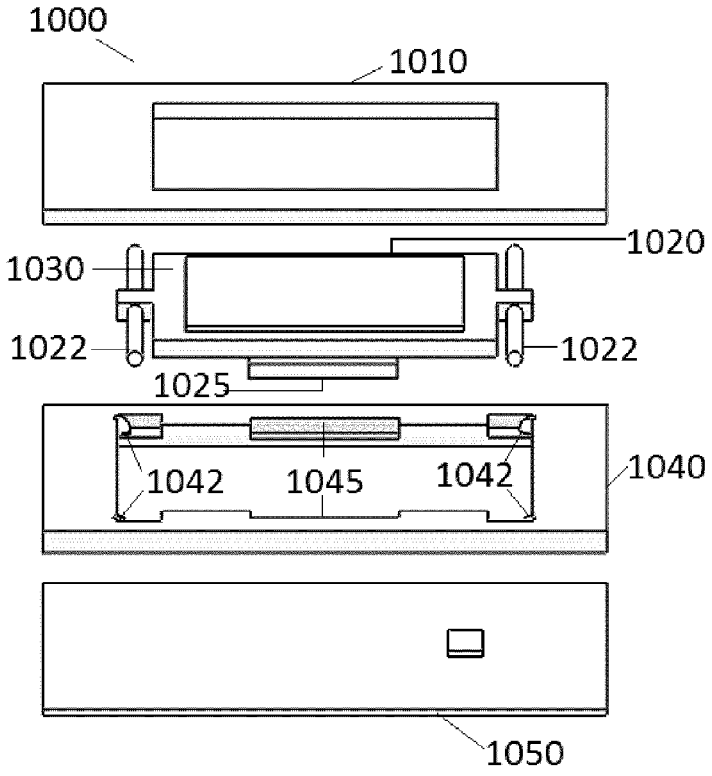
FIG. 21 shows an exploded isometric view of a sixth embodiment configure according with the techniques described herein.
Figure 22:
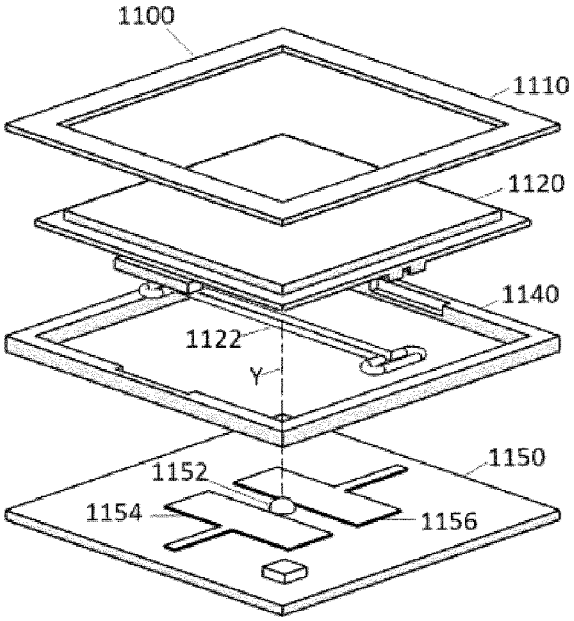
FIG. 22 shows an exploded isometric view of a seventh embodiment configure according with the techniques described herein.
Figure 23:
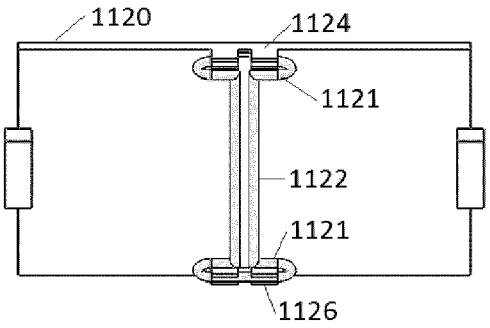
FIG. 23 illustrates an isometric view of the underside of the movable keycap from the seventh embodiment.

FIGS. 21-23 illustrate the remaining preferred configurations of the present invention. It is obvious to anyone skill in the art that the operation of the tension/return mechanism stays the same and will not be described. In some instance, these configurations are preferable due to the ease of manufacturing or depending on the suitability of the application. FIG. 21 shows key assembly 1000. It resembles key assembly 800, except the flexible rods are located in the keycap and the tapered protrusions are part of the support plate. The key assembly 1000 comprises of top plate 1010, a movable keycap 1020, a support plate 1040 and a switch plate 1050. The movable keycap 1020 has tabs 1025 which fit into the recess 1045 on the support plate 1040. The tabs are design to align the movable keycap 1020 within the support plate 1040. The top plate 1010 covers the recess edge 1030 using it as a guide to hold the movable keycap 1020 to the support plate 1040. In this configuration, the two flexible rods 1022 are part of the movable keycap 1020. At the ready position, the flexible rods 1022 rest atop the four tapered protrusions 1042 located within the support plate 1040. The protrusions 1042 are more tapered near the top surface of the support plate 1040 and less tapered toward the bottom of the support plate 1040. A downward force like a keypress will pushes the flexible rods 1022 against the tapered protrusion 1042 and flex the rods. At the end the keypress, the switch contact member (not shown) located on the underside of movable keycap 1020 strikes the switch plate 1050 actuating a keystroke. Once, the force is released, the flexible rods 1022 spring back to their original shape and push the movable keycap 1020 upward to the ready position. This embodiment exhibit same tension/return mechanism as previously described. The user experiences the same tactile and audible feedbacks.

FIGS. 22-23 depict still another preferred configuration key assembly 1100. Only the change from key assembly 1000 will be described. The simple design make key assembly 1100 an ideal keyswitch in many electronic applications where switches or buttons are used. The design relies on fewest parts possible. The key assembly comprises of a top plate 1110, a movable keycap 1120, a support plate 1140 and a switch plate 1150. The top plate 1110 and support plate 1140 perform the function of holding the movable keycap 1120 in place and aligning with the switch plate 1150. The difference between key assembly 1000 and 1100 are the flexible rod 1122 and the tapered protrusion 1152 position. The flexible rod 1122 is one piece, it is clamped by a set of clips 1124 and 1126 to the underside of the movable keycap 1120. The flexible rod 1122 is shaped like a symmetrical hair pin with open loops 1121. The open loop 1121 helps to improve the flex response of the flexible rod 1122 inside a miniature keyswitch. The tapered protrusion 1152 is located on the switch plate 1150, just underneath the midsection of the flexible rod 1122 as indicated by the dotted line Y. The shape of the tapered protrusion 1152 in this particular configuration is a semi spherical, other shapes also work as long as the top is more tapered that the bottom of the protrusion. A keypress pushes the flexible rod 1122 against the tapered protrusion 1152 and flexes the rod 1122. At the end of the key travel, the movable keycap 1120 reaches the switch plate 1150 and brings each side of the flexible rod 1122 which is made of conductive material into contact with the two electrical conductive strips 1154 and 1156 thereby achieving an electrical coupling. Once, the pressure on the movable keycap 1120 is released, the flexible rod 1122 reverts to its original shape and pushes the movable keycap 1120 back to the ready position.

While the implementations discussed herein apply to keyswitch and keyboard, those skill the art should appreciate that other implementation may also be employed. Examples of such implementations include a control panel, touchpad, touchscreen, or any other surface for human-computer interface.

Although this invention has been described with preferred embodiments, it is understood that the scope of the invention should be defined by the appended claims and not by the specific embodiments.

What is claimed is:

1. An electronic input device comprising at least one key assembly within a single top plate, a single support plate including a single key switch layer;

within the top plate is at least one movable keycap comprising at least one protrusion, below which is the support plate comprising at least one substantially planar flexible rod; and below which is the key switch layer; wherein the flexible rod is contained within a plane defined by the support plate except during vertical downward movement of the protrusion from an applied force on the keycap; which causes the protrusion to act upon the flexible rod causing horizontal displacement of the flexible rod; conversely removal of the applied force causes the flexible rod to act upon the protrusion causing vertical upward movement of the keycap.

2. The key assembly of claim 1, wherein the key switch layer indicates a key press operation through electrical coupling during actuation by the protrusion with a keyswitch.

3. The key assembly of claim 1, further comprising at least one light source on the key switch layer serving to back light the key assembly.

4. The key assembly of claim 1, further comprising a flexible, protective, top covering sheet adhered to the support plate and covering the top plate and keycap.

5. The key assembly of claim 1, wherein the top plate sets within a recessed edge of the movable keycap.

6. The key assembly of claim 1, wherein the protrusion is shaped to compliment engagement with the flexible rod.

7. The key assembly of claim 6, wherein the protrusion further comprises;

a lower section; and an upper section; wherein a cross section of the lower section has a smaller perimeter than a cross section of the upper section; such that during a keystroke, the applied force varies during the transition from the lower section to the upper section while the protrusion pushes against the flexible rod requiring a greater force thereby providing a tactile pre-actuation feedback to a user.

8. The key assembly of claim 1, wherein each flexible rod independently deflects during displacement.

9. The key assembly of claim 8, wherein the flexible rod is shaped to compliment engagement with the protrusion.

10. The key assembly of claim 9, wherein the flexible rod is capable of resuming its original shape and position after being deformed or displaced.

11. The key assembly of claim 10, wherein the flexible rod comprises one of spring steel, metal alloy, plastic, polymer or elastomeric composites.

12. An electronic input device comprising at least one key assembly within a single top plate, a single support plate including a single switch plate;

within the top plate is at least one movable keycap comprising at least one substantially planar flexible rod, below which is the support plate, below which is the switch plate comprising at least one protrusion; wherein vertical downward movement of the keycap from an applied force causes horizontal displacement of the flexible rod against the protrusion; conversely, removal of the applied force causes the flexible rod to act upon the protrusion causing vertical upward movement of the keycap.

13. The key assembly of claim 12, wherein the key switch layer indicates a key press operation during actuation by the flexible rod and conductive strips on the switch plate.

14. The key assembly of claim 12, further comprising at least one light source on the key switch layer serving to back light the key assembly.

15. The key assembly of claim 12, further comprising a flexible, protective, top covering sheet adhered to the support plate and covering the top plate and keycap.

16. The key assembly of claim 12, wherein the top plate sets within a recessed edge of the movable keycap.

17. The key assembly of claim 12, wherein the protrusion is shaped to compliment engagement with the flexible rod.

18. The key assembly of claim 17, wherein the protrusion further comprises;

a lower section; and an upper section; wherein a cross section of the lower section has a larger perimeter than a cross section of the upper section; such that during a keystroke, the applied force varies during the transition from the upper section to the lower section while the protrusion pushes in between the flexible rod requiring a greater force thereby providing a tactile pre-actuation feedback to a user.

19. The key assembly of claim 12, wherein each flexible rod independently deflects during displacement.

20. The key assembly of claim 19, wherein the flexible rod is shaped to compliment engagement with the protrusion.

21. The key assembly of claim 20, wherein the flexible rod is capable of resuming its original shape and position after being deformed or displaced.

22. The key assembly of claim 21, wherein the flexible rod comprises one of spring steel, conductive alloy, plastic, polymer or elastomeric composites.

23. An input device comprising a least one key assembly; each key assembly comprising:

a movable keycap, the movable keycap comprises at least one protrusion forming a surface or edge; and a support plate, the support plate comprises a substantially planar return mechanism and a recess; and an alignment mechanism, the alignment mechanism comprises at least one of, a top plate, feet or tabs; where the at least one protrusion is positioned atop the return mechanism such that a pressing force on the keycap results in vertical downward movement of the keycap causing the surface or edge of the protrusion to displace and flex the return mechanism in a relatively perpendicular direction to the vertical downward movement of the keycap with the alignment mechanism stabilizing the keycap within the recess.

24. The input device of claim 23, further comprising a flexible, protective, top covering sheet adhered to the support plate and covering the top plate and keycap.

25. The input device of claim 23, wherein the keycap comprising at least one of retention tabs or feet to align the keycap with the support plate.

26. The input device of claim 23, wherein the top plate sets within a recessed edge of the movable keycap.

27. The input device of claim 23, wherein multiple key assembly having a keyboard configuration can be used as an input for a touch surface, the key assembly overlay a virtual keyboard having the touch surface acting as a key switch layer.

28. The input device of claim 23, further comprising a key switch layer.

29. The input device of claim 28, wherein the key switch layer indicates a key press operation through electrical coupling during actuation by the protrusion with a key-switch.

30. The input device of claim 28, further comprising at least one light source on the key switch layer serving to back light the key assembly.

31. The input device of claim 23, wherein the surface of the protrusion can be one of tapered surface, tapered edge, semi sphere, a square pyramid, a cone or a cylinder.

32. The input device of claim 31, wherein the flexible rod is shaped to compliment engagement with the protrusion.

33. The input device of claim 23, wherein the return mechanism comprises at least one flexible rods.

34. The input device of claim 33, wherein the flexible rod includes one or multiple arcuate sections allowing each flexible rod independently deflects with minimal impact to adjacent key assemblies.

35. The input device of claim 34, where the flexible rod is capable of resuming its original shape and position after being deformed or displaced.

36. The input device of claim 35, wherein the flexible rod comprise one of spring steel, metal alloy, plastic, polymer or elastomeric composites.

37. The input device of claim 36, wherein the flexible rod can have a round shape, square shape, or tapered edge.

38. The input device of claim 37, wherein the protrusion is shaped to compliment engagement with the flexible rod.

39. The input device of claim 38, wherein the protrusion further comprises;

a lower section; and an upper section; wherein a cross section of the lower section has a smaller perimeter than a cross section of the upper section; such that during a keystroke, the applied force varies during the transition from the lower section to the upper section while the protrusion pushes in between the flexible rod requiring a greater force thereby providing a tactile pre-actuation feedback to a user.

* * * * *